US006243049B1

(12) United States Patent
Chandler

(10) Patent No.: US 6,243,049 B1
(45) Date of Patent: Jun. 5, 2001

(54) MULTI-PATTERN ANTENNA HAVING INDEPENDENTLY CONTROLLABLE ANTENNA PATTERN CHARACTERISTICS

(75) Inventor: Charles W. Chandler, San Gabriel, CA (US)

(73) Assignee: TRW Inc., Redondo Beach, CA (US)

( * ) Notice: Subject to any disclaimer, the term of this patent is extended or adjusted under 35 U.S.C. 154(b) by 0 days.

(21) Appl. No.: 09/405,765

(22) Filed: Sep. 27, 1999

(51) Int. Cl.[7] ..... H01Q 13/00

(52) U.S. Cl. ..... 343/786; 343/772; 343/776; 343/725

(58) Field of Search ..... 343/786, 785, 343/775, 840, 725; 315/772, 776

(56) References Cited

U.S. PATENT DOCUMENTS

| | | | | |
|---|---|---|---|---|
| H584 | * | 2/1989 | Schwering et al. | 343/785 |
| 4,489,331 | * | 12/1984 | Salvat et al. | 343/753 |
| 5,038,151 | * | 8/1991 | Kaminski | 343/727 |
| 5,041,840 | * | 8/1991 | Cipolla et al. | 343/725 |
| 5,109,232 | * | 4/1992 | Monte | 343/785 |

OTHER PUBLICATIONS

Modern Antenna Design, Milligan pp. 179–213, Chapter 7.

* cited by examiner

*Primary Examiner*—Don Wong
*Assistant Examiner*—Tuyet T. Vo

(74) *Attorney, Agent, or Firm*—Michael S. Yatsko; Connie M. Thousand

(57) ABSTRACT

An antenna for providing a first antenna pattern at a first frequency of operation and a second antenna pattern at a second frequency of operation from first and second RF signals, respectively. The antenna included a horn which is dimensioned to generate the first antenna pattern from the first RF signal. A conduit is located within the horn and is configured to propagate the second RF signal in a waveguide mode. A corrugated rod having a first and a second portion is associated with the conduit. The first portion of the rod is located inside the conduit and the second portion of the rod protrudes from the conduit into the horn. The rod is configured to be responsive to the second RF signal and is operative to transition the second RF signal from a waveguide mode to a surface wave mode and propagate the second RF signal in a surface wave mode along the rod. The rod is configured to generate a second antenna from the second RF signal propagating in a surface wave mode. The first antenna pattern has first antenna pattern characteristics and the second antenna pattern has second antenna pattern characteristics. Changes in the dimensions of the horn will alter the pattern characteristics of the first antenna pattern but will have substantially no effect on the characteristics of the second antenna pattern. Changes in the length of the first portion of the rod will alter the pattern characteristics of the second antenna pattern but have substantially no effect on the pattern characteristics of the first antenna pattern generated by the horn.

19 Claims, 10 Drawing Sheets

MULTI-PATTERN ANTENNA HAVING INDEPENDENTLY CONTROLLABLE ANTENNA PATTERN CHARACTERISTICS

BACKGROUND OF THE INVENTION

The present invention relates generally to antennas and more particularly, to an antenna which provides a plurality of antenna patterns at a plurality of frequencies from a single aperture with the characteristics of each antenna pattern being independently controllable.

Antennas are used on spacecraft to provide multiple uplink and downlink communication links between the spacecraft and the ground. The downlinks operate at one frequency, for example around 20 GHz, and the uplinks operate at a second higher frequency, for example around 30 or 44 GHz. It is usually desirable for a single spacecraft to provide multiple uplink and downlink antenna patterns with each antenna pattern having specific characteristics such as gain and beamwidth. It is also desirable to provide both an uplink and downlink antenna pattern which have the same beamwidth so that a user on the ground can both receive and transmit to the same spacecraft. The method typically used to provide multiple uplink and downlink antenna patterns from a single spacecraft is to provide separate reflectors for each uplink and downlink antenna. This requires a large amount of space on a spacecraft, is expensive and extracts a weight penalty. Therefore, it is desirable to save weight by coupling multiple antennas together in a single structure.

One method used to save weight is to couple one uplink antenna and one downlink antenna together in a single reflector structure where the uplink and downlink antennas share a common reflector. Typically, a single feed horn is configured to simultaneously illuminate a reflector with two RF signals, each at different frequency. The two RF signals are reflected by the reflector which transforms each RF signal into a separate antenna pattern. A disadvantage with this structure is that adjustments to the feed horn affect the characteristics of both antenna patterns making it difficult to provide a plurality of antenna patterns having preselected characteristics at different frequencies from a single feed horn. To decouple the adjustment of each RF signal typically requires using a plurality of adjacently located feed horns positioned about the focus of the reflector where each RF signal is generated by a separate feed horn. The disadvantage with this design is that the feed horns occupy a significant amount of space and create blockage and losses in the antenna patterns.

What is needed therefore is a single, compact antenna which provides a plurality of antenna patterns, where each antenna pattern characteristic is independently controllable and can be adjusted without affecting the pattern characteristics of another antenna pattern, but does not require multiple adjacently positioned horns.

SUMMARY OF THE INVENTION

The preceding and other shortcomings of the prior art are addressed and overcome by the present invention which provides a multi-pattern antenna for generating a first antenna pattern at a first frequency of operation and a second antenna pattern at a second frequency of operation from first and second RF signals, respectively. The antenna included a horn which is dimensioned to generate the first antenna pattern from the first RF signal.

A conduit is located within the horn and is configured to propagate the second RF signal in a waveguide mode. A corrugated rod having a first and a second portion is positioned so that the first portion of the rod is located inside the conduit and the second portion of the rod protrudes from the conduit into the horn. The rod is configured to be responsive to the second RF signal and is operative to transition the second RF signal from a waveguide mode to a surface wave mode and propagate the second RF signal in a surface wave mode along the rod. The rod is configured to generate a second antenna pattern having second antenna pattern characteristics from the second RF signal propagating in a surface wave mode.

In a first aspect, changes in the dimensions of the horn will alter the pattern characteristics of the first antenna pattern but will have substantially no effect on the characteristics of the second antenna pattern.

In a second aspect, changes in the length of the second portion of the rod will alter the pattern characteristics of the second antenna pattern but have substantially no effect on the pattern characteristics of the first antenna pattern generated by the horn.

BRIEF DESCRIPTION OF THE DRAWINGS

Reference is now made to the detailed description of the preferred embodiments illustrated in the accompanying drawings, in which.

DETAILED DESCRIPTION OF THE PREFERRED EMBODIMENTS

Figure 1:
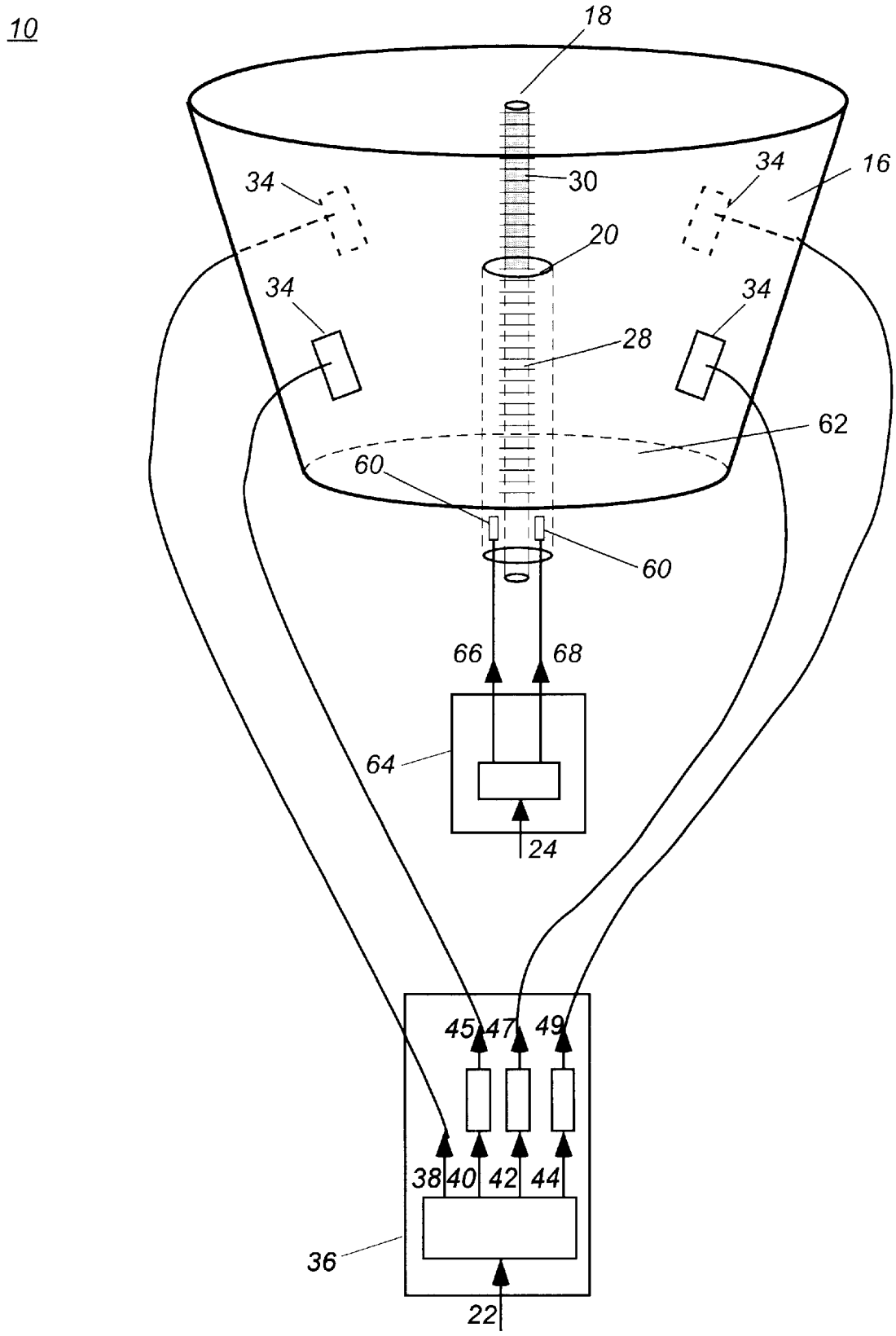
FIG. 1 is an isometric view of a multi-pattern antenna in accordance with a first embodiment of the invention.
Figure 2:
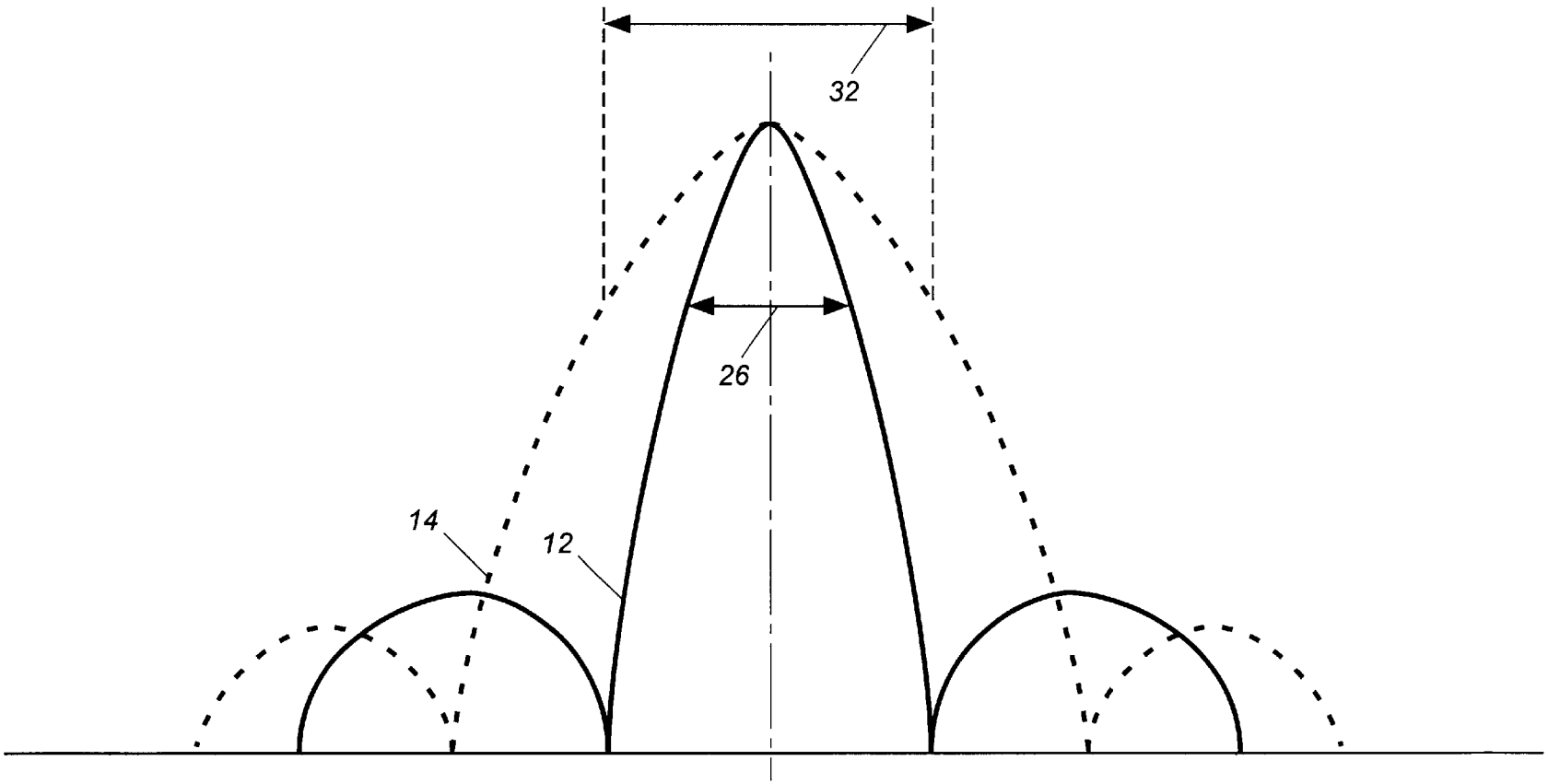
FIG. 2 shows antenna patterns generated by the multi-pattern antenna of FIG. 1.

Referring to FIGS. 1 & 2, a multi-pattern antenna 10 for generating two antenna patterns 12,14 from a single compact structure is illustrated. The multi-pattern antenna 10 can be configured to provide transmit only antenna patterns, receive only antenna patterns or a combination of transmit and receive antenna patterns. For ease of explanation, the present invention will be primarily explained for the transmit-only case.

The antenna 10 includes a horn 16, a rod 18, and, a conduit 20 where the conduit 20 surrounds a first portion of the rod 18. The horn 16 can be a conical horn, a corrugated horn, a square horn, an elliptical horn or any other horn type antenna known to one skilled in the art. A more detailed discussion of horn antennas can be found on pages in Chapter 7, at pp. 179–213 of *Modern Antenna Design* by Milligan.

The multi-pattern antenna 10 is adapted to receive a first 22 and a second 24 radio-frequency (RF) signal and is configured to couple the first 22 and second 24 RF signals into the antenna 10. The preferred methods to do so will be subsequently discussed. For the preferred embodiment of the invention, the first RF signal 22 has a first frequency of operation and the second RF signal 24 has a second frequency of operation. The horn 18 is configured and dimensioned to generate the first antenna pattern 12 from the first RF signal 22. The characteristics of the first antenna pattern 12, in particular the beamwidth 26, is substantially determined by the configuration and dimensions of the horn 16. The characteristics of the first antenna pattern 12 are adjustable by adjusting the dimensions and configuration of the horn 16. For the preferred embodiment of the invention, the first antenna pattern 12, generated by the horn 16, is approximately symmetrical in shape.

The conduit 20 is located within the horn 16 and is dimensioned to propagate the second RF signal 24 in a waveguide mode. The conduit 20 is preferably cylindrical in shape and is positioned in approximately the center of the horn 16 so as to provide a smooth, symmetrical configuration to the first RF signal 22, which is simultaneously propagating in the horn 16, since a horn 18, which is configured to be smooth and symmetrical generates a corresponding antenna pattern 12, which is substantially symmetrically shaped. Alternatively, the conduit 20 is configured to have a square, rectangular or oval cross-section or can be configured in any shape known in the art to propagate a RF signal 24 in a waveguide mode. The conduit 20 can also be in the shape of a horn.

The rod 18 is positioned within the horn 16 with a first portion 28 of the rod 18 being located within the conduit 20 and a second portion 30 the rod 18 extending from the conduit 20. The first 28 and second 30 portions together comprising the length of the rod 18. The first portion 28 of the rod 18 is responsive to the second RF signal 24 propagating in a waveguide mode within the conduit 20. The first portion 28 of the rod 18 is operative to transition the second RF signal 24 from propagating in a waveguide mode in the conduit 20 to propagating in a surface wave mode along the length of the rod 18. To do so, the rod 18 is configured with corrugations having dimensions which are preselected to transition the second RF signal 24 from a waveguide mode to a surface wave mode and propagate the second RF signal 24 along the length of the rod 18 in a surface wave mode. The exact dimensions of the rod 18 are preselected with the aid of a computer program such as the ABKOR Program, which is commercially available through the University of Mississippi.

The length of the conduit 20 is selected to be of a preselected length to contain the second RF signal 24 within the conduit 20 until a sufficient amount of the second RF signal 24 has transitioned into a surface wave mode. It is preferred that the conduit 20 be long enough to contain the second RF signal 24 in a waveguide mode until at least 80% of the second RF signal 24 has transitioned from a waveguide mode into a surface wave mode to avoid incurring an undesirable amount of coupling between the first 22 and second 24 RF signals.

The second RF signal 24 propagates down the length of the rod 18 in a surface wave mode and radiates from the rod 18. The second antenna pattern 14 is generated from the radiated second RF signal 24. The characteristics of the second antenna pattern 14, particularly the beamwidth 32, is substantially determined by the dimensions, particularly the length, of the rod 18 which generated the second antenna pattern 14. For example, a short rod 18 will generate an antenna pattern 14 having a broad beamwidth 32 whereas a long rod 18 will generate an antenna pattern 14 having a narrow beamwidth 32. The actual dimensions of the rod 18 required to generate an antenna pattern 14 having preselected antenna pattern characteristics is determined with the aid of the computer program mentioned above.

Although changing the dimensions of the rod 18 changes the characteristics of the second antenna pattern 14, changing the dimensions of the rod 18 has little to no effect on the pattern characteristics of the first antenna pattern 12 which was generated by the horn 16. Similarly, changing the dimensions of the horn 16 in order to change the pattern characteristics of the first antenna pattern 12 which was generated by the horn 16 has little to no effect on the pattern characteristics of the second antenna pattern 14 which was generated by the rod 18. In this manner, the multi-pattern antenna 10 provides two antenna patterns 12, 14 from a single compact configuration where the pattern characteristics of each antenna pattern 12, 14 is independently controllable.

For the preferred embodiment of the invention, a plurality of openings 34 are positioned at preselected locations on the wall of the horn 16. The openings 34 are preferably slots 34 which are adapted to receive the first RF signal 22 and are configured to couple the first RF signal 22 into the horn 16. The number of slots 34 needed is dependent on the desired polarization of the first antenna pattern 12 which is subsequently generated from the first RF signal 22.

For example, to provide a first antenna pattern 12 which is circularly polarized requires four slots 34 which are positioned approximately 90 degrees apart from one another on the wall of the horn 16. These slots 34 are used to couple the first RF signal 22 into the multi-pattern antenna 10. To do so, a coupler 36 is provided which is responsive to the first RF signal 22 and is operative to divide the first RF signal 22 into four intermediate RF signals 38–44, preferably of approximately equal signal strengths. The coupler 36 is also operative to phase delay the second 40, third 42, and fourth 44 intermediate signals by approximately 90 degrees, 180 degrees and 270 degrees respectfully with respect to the first intermediate signal 38 providing first 45, second 47 and third 49 delayed signals from the second 40, third 42 and fourth 44 intermediate signals, respectively. The coupler 36 can be a hybrid coupler such as that commercially available by Millitech Corporation located in South Deerfield, Mass. The coupler 36 can also be a plurality of Lange couplers or any other RF device known to one skilled in the art to divide an RF signal 22 into four intermediate signals 38–44 and phase delay the intermediate signals 38–44 a preselected amount with respect to each other.

The first intermediate signal 38 and each delayed signal 40–44 are coupled into the horn 16 through the slots 34 using coupling techniques which are well known in the art. The signals 38–44 are coupled into the horn 16 in a preselected manner to provide a preselected phase progression so that the antenna pattern 12 generated from the first RF signal 22 will be either right or left-hand circularly polarized.

Figure 3:
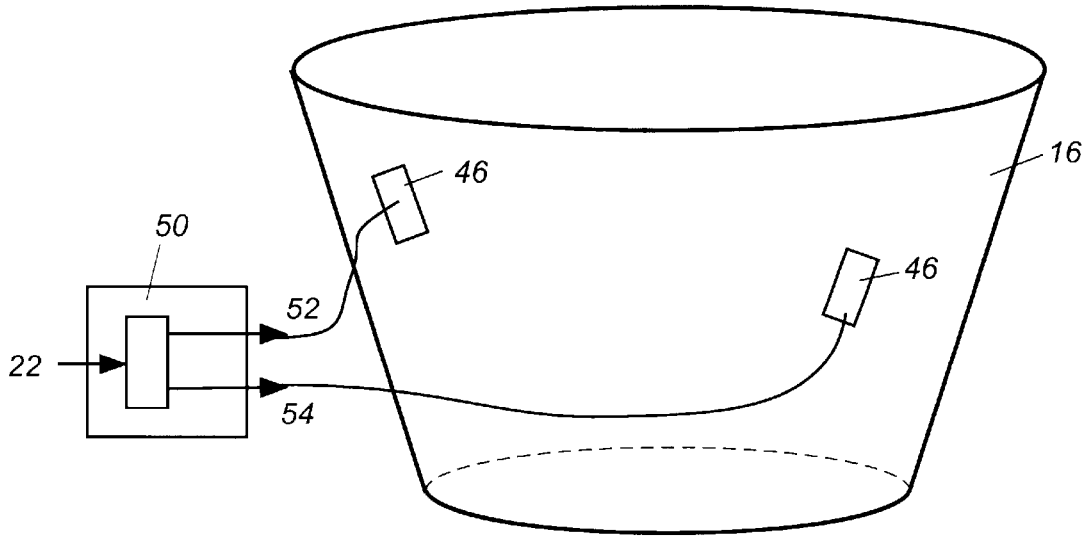
FIG. 3 is an isometric view of a portion of a multi-pattern antenna in accordance with a second embodiment of the invention.

Alternatively, as shown in FIG. 3, for a second embodiment of the invention, to generate a linearly polarized antenna pattern requires only two slots 46 which are positioned ninety degrees apart on the wall of the horn 16 and a coupler 50 which divides the first RF signal 16 into two intermediate signals 52, 54 and delays one intermediate signal 54 by ninety degrees with respect to the other intermediate signal 52. The coupler 50 can be a hybrid coupler such as that commercially available by Millitech Corporation located in South Deerfield, Mass., but can also be any RF device known to one skilled in the art to divide an RF signal 16 into two intermediate signals 50, 54 and delay one of the intermediate signals 54 approximately ninety degrees with respect to the other intermediate signal 52.

Referring once again to FIGS. 1 & 2, the second RF signal 24 is preferably coupled into the antenna through slots 60 positioned in the wall of the conduit 20. To do so, the conduit 20 is positioned so that a portion of the conduit 20 extends from the back 62 of the horn 16 and the slots 60 are located in the extended portion of the conduit 20. The second RF signal 24 is coupled into the conduit 24 through the slots 60.

The number of slots 60 needed to couple the second RF signal 24 into the conduit 20 is dependent on the desired polarization of the second antenna pattern 14 which is subsequently generated from the second RF signal 24. For example, two slots 60 positioned ninety degrees apart from each other on the wall of the conduit 20 are required to provide a second antenna pattern 14 which is circularly polarized. A coupler 64 is operative to divide the second RF signal 24 into two intermediate signals 66, 68 and delay one intermediate signal 68 by ninety degrees with respect to the other intermediate signal 66. The intermediate signals 66, 68 are coupled into the slots 60 in a preselected manner which is known in the art to provide a right or left hand circularly polarized second antenna pattern 14 from the second RF signal 24. Alternatively, to produce a linearly polarized second antenna pattern 14 requires coupling the second RF signal 24 into the conduit 20 through a single slot 60.

Figure 4:
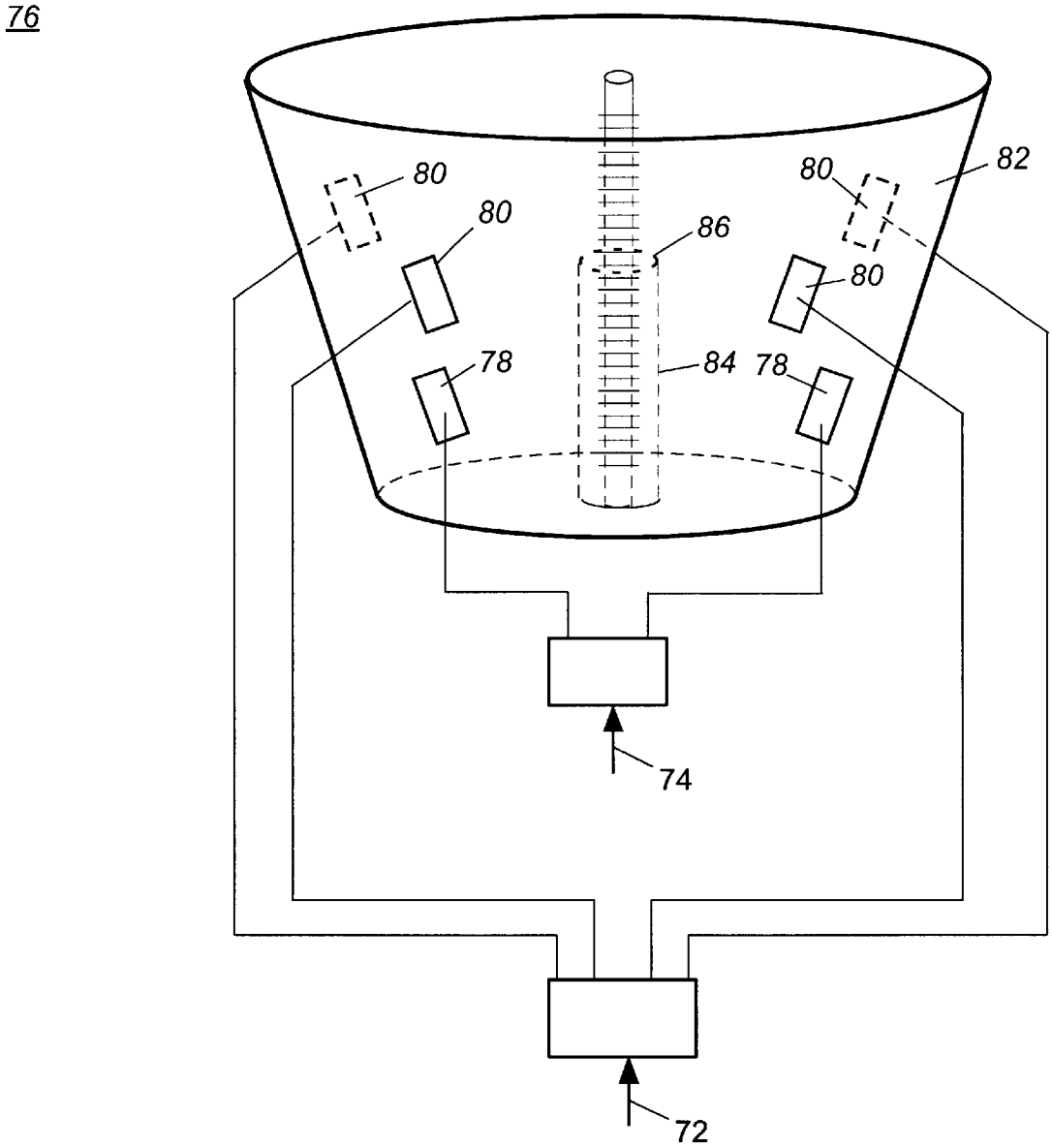
FIG. 4 is an isometric view of a multi-pattern antenna in accordance with a third embodiment of the invention.

Referring to FIG. 4, for a third embodiment of the invention, the first 72 and the second 74 RF signals have first and second frequency bands of operation, respectively, and are coupled into the antenna 76 through slots 78, 80, respectively, in the wall of the horn 82 in the manner described above. The dimensions of the horn 82 are preselected so that the horn 82 propagates the first RF signal 72 but does not propagate the second RF signal 74. The physical dimensions of the conduit 84 are preselected to propagate an RF signal 74 having the second frequency band of operation and not propagate an RF signal having the first frequency band of operation such as the first RF signal 72. The second RF signal 72 couples into the conduit 84 through the top 86 of the conduit 84 and propagates in the conduit 84 in the manner described above, and the first RF signal 72 propagates in the horn 82.

Figure 5:
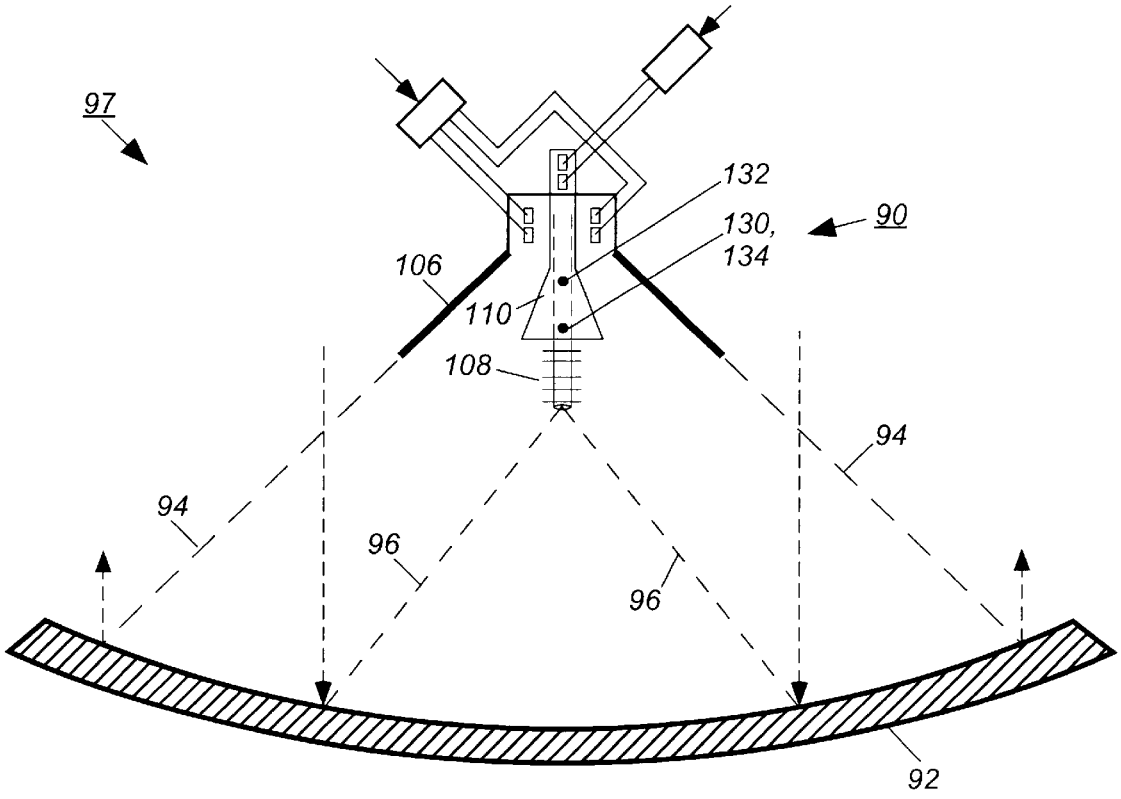
FIG. 5 is a side view of a multi-pattern antenna coupled to a reflector in accordance with a fourth embodiment of the invention.
Figure 6:
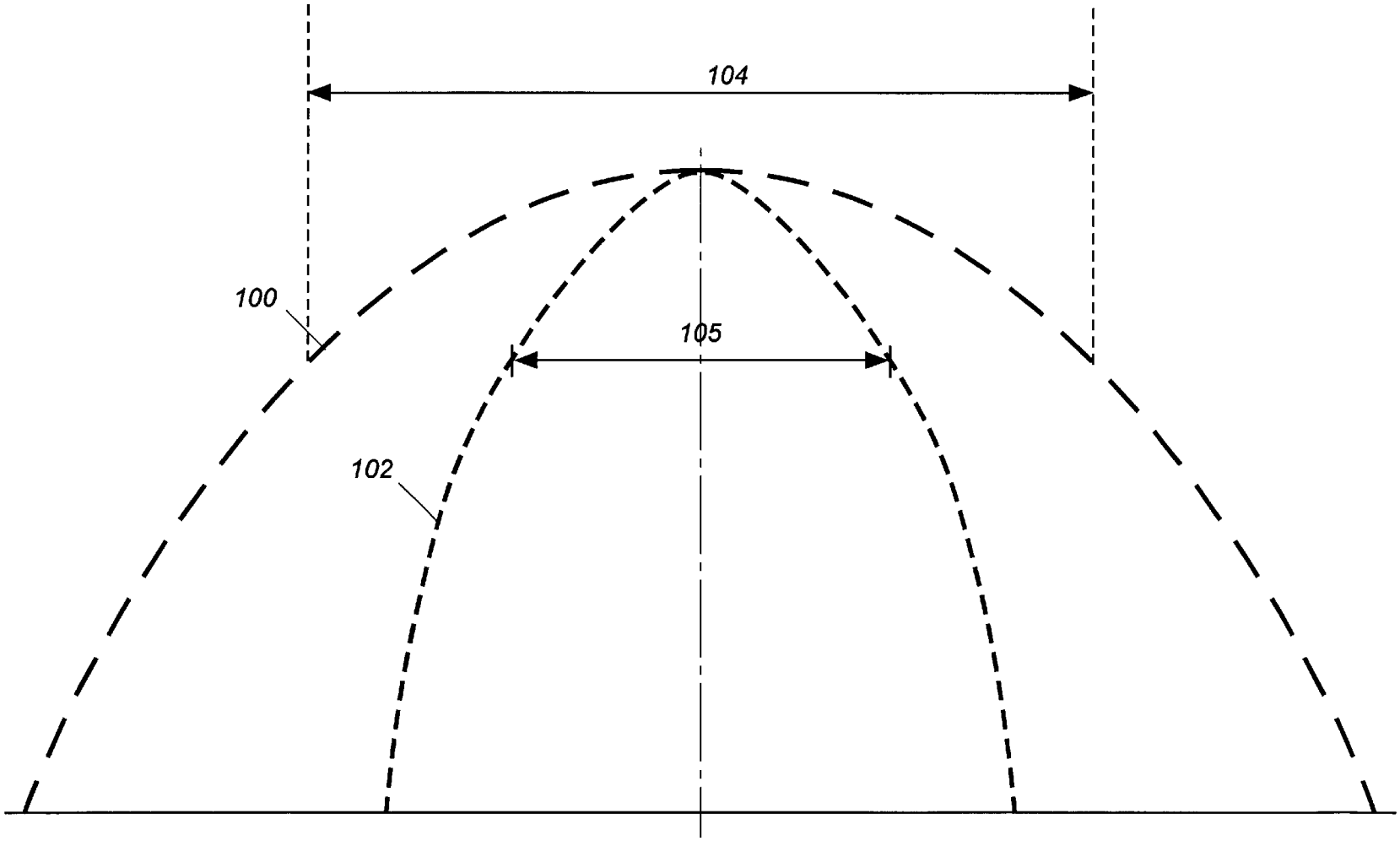
FIG. 6 shows antenna patterns generated by the multi-pattern antenna of FIG. 5.

Referring to FIGS. 5 & 6, for the fourth embodiment of the invention, the multi-pattern antenna 90 is coupled to a reflector 92 and the first and second antenna patterns, depicted by the lines marked 94 & 96, respectively, which are generated by the multi-pattern antenna 90 are configured as illumination patterns 94, 96 which are positioned to illuminate the reflector 92. The reflector 92 and multi-pattern antenna 90 together comprise a multi-pattern reflector antenna 97 which is preferably mounted on a spacecraft (not shown) which is in orbit about the earth and is used to provide communications with the earth. Preferably, the first 94 and second 96 illumination patterns are at frequencies of 20 GHz and 30 GHz, respectively, and the multi-pattern reflector antenna 97 is configured to provide up 100 and downlink 102 antenna patterns at frequencies of approximately 20 and 30 GHz from the first 94 and second 96 illumination patterns, respectively, where uplink antenna pattern 100 is a receive antenna pattern and the downlink antenna pattern 102 is a transmit antenna pattern. To do so, the horn 106 of the multi-pattern reflector antenna 97 is configured to provide the downlink illumination pattern 94 and the rod 108 and conduit 110 are configured to provide the uplink illumination pattern 96. The uplink 96 and downlink 94 illumination patterns are incident on the reflector 92 which generates therefrom the uplink 100 and downlink 102 antenna patterns, respectively. The pattern characteristics of the downlink antenna pattern 102 are determined by the dimensions of the horn 106 as well as the configuration of the reflector 192 and can be altered by changing the dimensions of the horn 106, whereas the pattern characteristics of the uplink antenna pattern 100 are determined by the dimensions of the rod 108, particularly the rod length, and can be altered by changing the dimensions of the rod.

Figure 7:
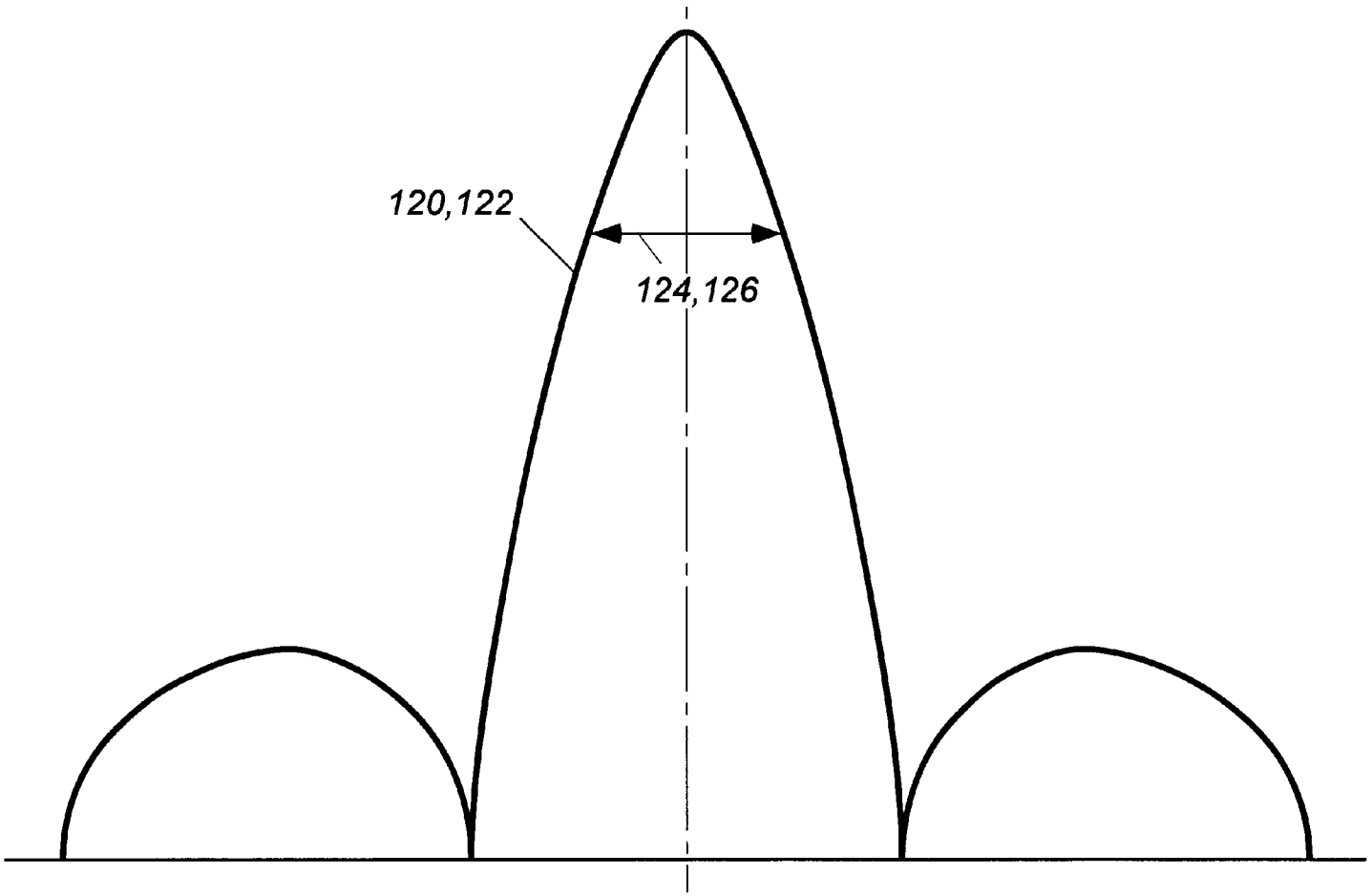
FIG. 7 shows antenna patterns having approximately equivalent beamwidths.

Referring to FIGS. 5 & 7, for the preferred embodiment of the invention, the dimensions of the horn 106 and the dimensions of the rod 108 are selected to provide uplink 120 and downlink 122 antenna patterns having approximately equivalent beamwidths 124, 126 which enable users on the ground to both receive from and transmit to the same spacecraft. To do so, the dimensions and lengths of the rod 104 and the dimensions of the horn 106 are preselected to provide the desired beamwidths 124, 126. The initial dimensions of the rod 108 and horn 106 are determined with the aid of the above mentioned computer program. If required, the pattern characteristics can be easily adjusted after building and testing of the antenna 97 has been conducted since adjustments in the rod 108 has virtually no affect on the characteristics of the downlink antenna pattern 122 which is generated by the horn 106 and vice versa. The dimensions of the horn 106 and rod 108 are preferably fixed prior to being placed on a spacecraft in order to provide antenna patterns 120, 122 with predetermined fixed pattern characteristics.

Figure 8:
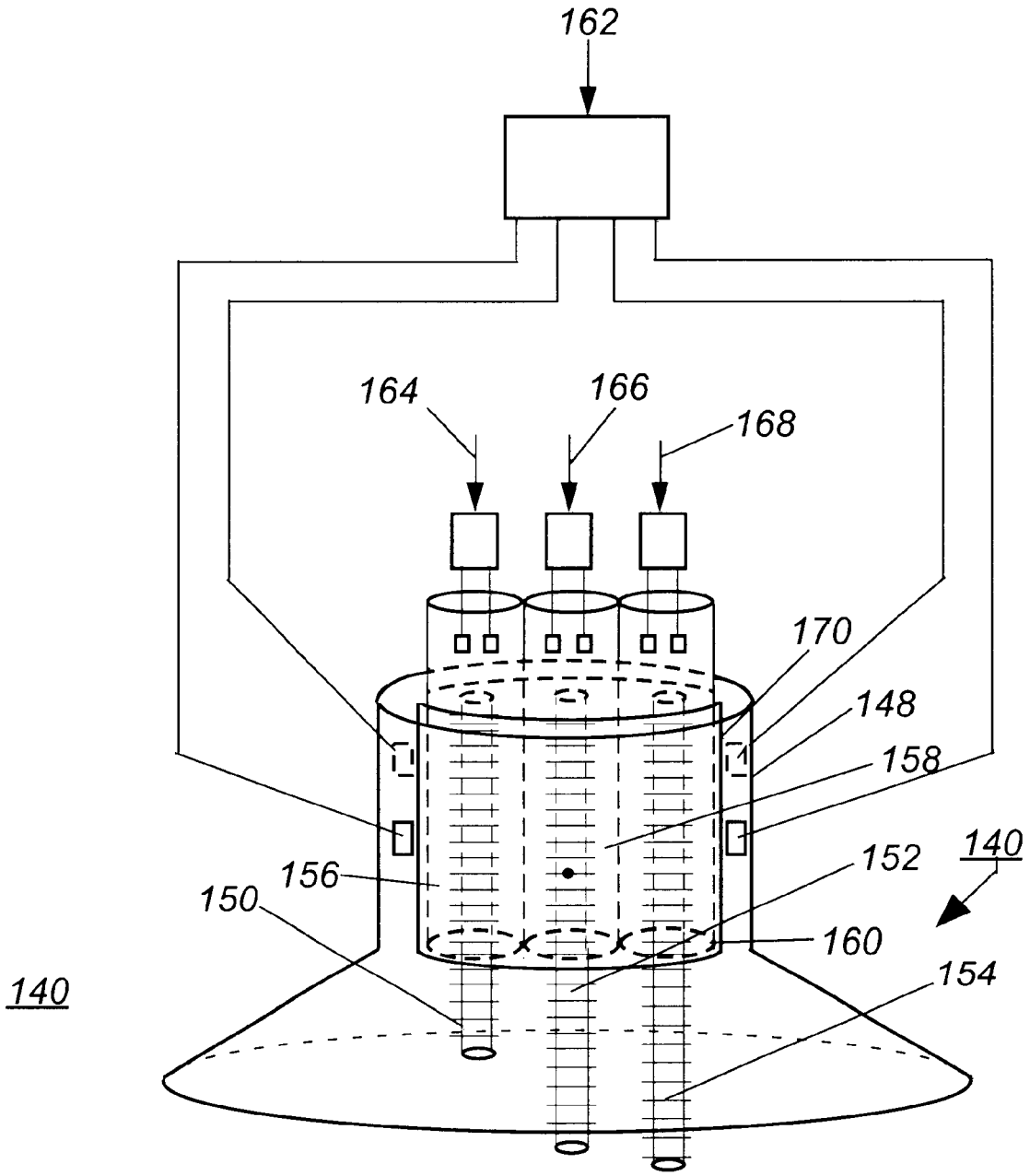
FIG. 8 is an isometric view of a multi-pattern antenna in accordance with a fifth embodiment of the invention.
Figure 9:
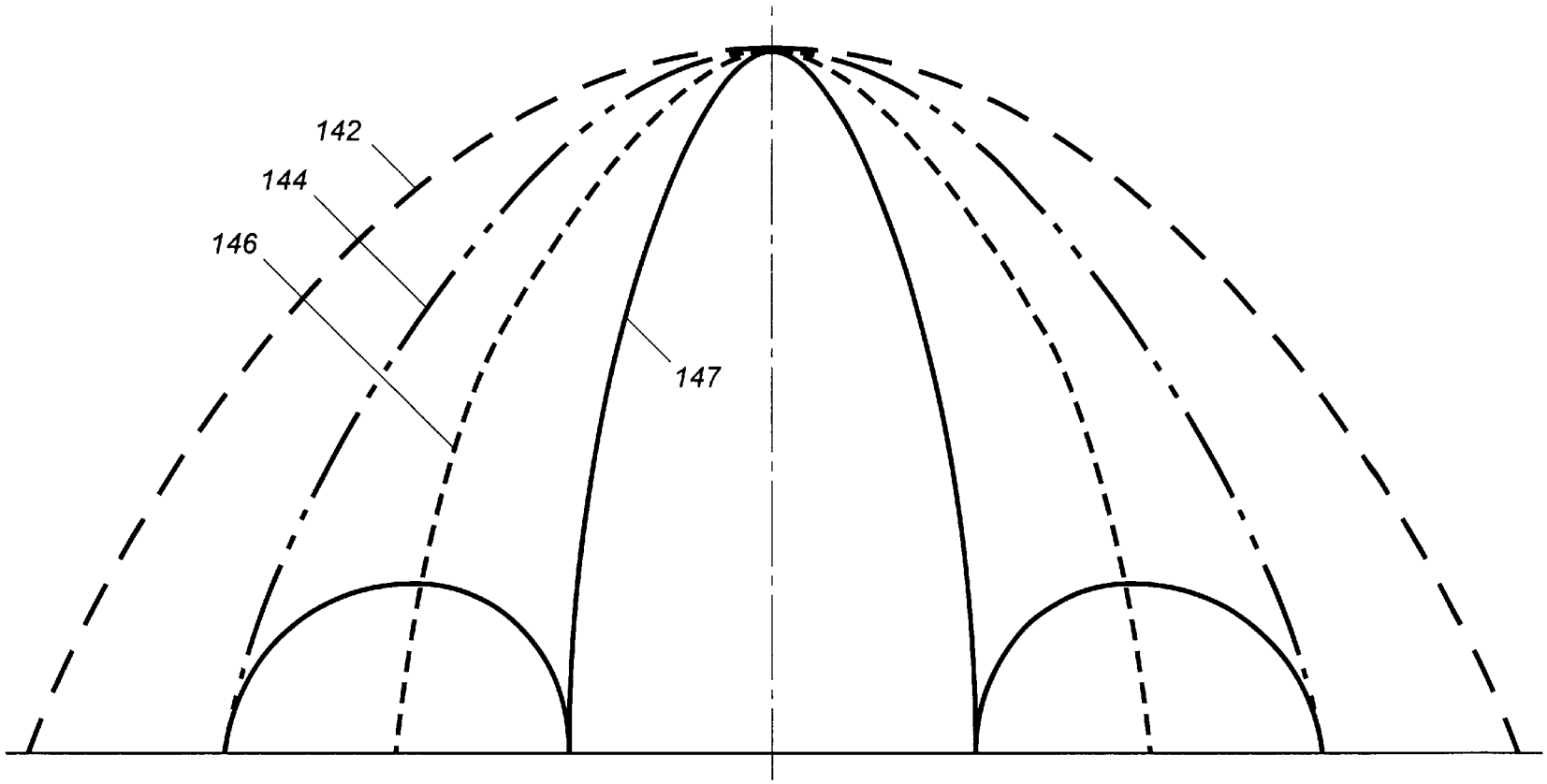
FIG. 9 shows antenna patterns generated by the multi-pattern antenna of FIG. 8; and, FIG. 10 is an isometric view of a dynamically adjustable multi-pattern antenna in accordance with a sixth embodiment of the present invention.

Referring back to FIGS. 5 & 6, it is desirable for spacecraft applications to produce antenna patterns 100, 102 having high efficiency by locating the phase center of the multi-focus antenna 90 at the focal point 130 of the reflector 92. However, typically, the multi-focus antenna 90 has two phase centers 132, 134, one of which 132 is associated with the rod 108 and the other of which 134 is associated with the horn 106. These phase centers 132, 134 are typically not co-located. As such, the phase center 134 of the horn 106 is co-located with the focal point 130 of the reflector 92 such that the downlink antenna pattern 102 which is generated by the horn 106 exhibits maximum efficiency. It is typically more important to produce a downlink antenna pattern 102 with maximum efficiency since inefficiencies in a downlink antenna pattern 102 typically must be compensated for by increasing the power supplied to the multi-pattern antenna 90. This requires larger, heavier power amplifiers (not shown) on the spacecraft which is undesirable and expensive. On the other hand, inefficiencies in the uplink antenna pattern 100 are compensated for by increases in electronic components located on the earth which is much less expensive. Referring now to FIGS. 8 & 9, for a fifth embodiment of the invention, the multi-focus antenna 140 generates a plurality of antenna patterns 142–147 and includes a horn 148, a plurality of rods 150–154 and a plurality of conduits 156–160 with each conduit 156–160 surrounding a portion of one of the rods 150–154, respectively.

The multi-pattern antenna 140 is adapted to receive a plurality of RF signals 162–168, preferably each being at a different frequency of operation. The horn 148 is configured and dimensioned to generate a first antenna pattern 142 from the first RF signal 162 in the manner described above, with the characteristics of the first antenna pattern 142, in particular the beamwidth, being substantially determined by the configuration and dimensions of the horn 148. As such, the characteristics of the first antenna pattern 142 are adjustable by adjusting the dimensions and configuration of the horn 148.

The conduits 156–160 are located within the horn 148. The dimensions of each conduit 156–160 are configured to propagate one of the RF signals 164–168, respectively, in a waveguide mode. The conduits 156–160 can be cylindrical in shape, rectangle, square, or any other shape known in the art to propagate a RF signal in a waveguide mode. The conduits 156–160 can also be horns.

Preferably, a large conduit 170 is positioned around the smaller conduits 156–160 to provide a smooth, symmetrical configuration to the first RF signal 162 propagating within the horn 148. As mentioned above, a smooth, symmetrically configured horn 148 will provide for a symmetrically shaped pattern from the first RF signal 162.

A rod 150–154 is associated with each conduit 156–160, respectively, with a first portion of each rod 150–154 being located within a conduit 156–160 and a second portion of each rod 150–154 extending from a conduit 156–160, respectively. Each rod 150–154 is responsive to the RF signal 164–168 propagating within the conduit 156–160 encompassing the rod 150–154, respectively. Each rod 150–154 is operative to transition one of the RF signals 164–168, respectively, from the waveguide mode into a surface wave mode and propagates that RF signal 164–168 along the length of the rod 150–154, respectively, in a surface wave mode. To do so, each rod 150–154 is configured with corrugations having dimensions which are preselected to transition one RF signal 164–168 from a waveguide mode into a surface wave mode and propagate that RF signal 164–168 in a surface wave mode along the length of a rod 150–154. The exact dimension of each rod 150–154 is determined with the aid of a computer program such as the ABKOR Program mentioned above.

The length of each conduit 156–160 is selected to be of a sufficient length to contain one of the RF signal 164–168, respectively, within a conduit 156–160 until a sufficient amount of each RF signal 164–168 has transitioned into a surface wave mode. Each rod 150–154 is configured to generate an antenna pattern 144–148 from the RF signal 164–168 propagating down the respective rod 150–156. The characteristics of each antenna pattern 144–147, particularly the beamwidth, is substantially determined by the dimensions, particularly the length, of the rod 150–156 generating the respective antenna pattern 144–147. For example, a short rod 150 will generate an antenna pattern 144 having a broader beamwidth than the beamwidth of an antenna pattern 146 generated by a longer rod 152. The actual dimensions of each rod 150–156 required to generate an antenna pattern 144–147, respectively, having preselected antenna pattern characteristics is determined with the aid of the computer program mentioned above.

Although changing the dimensions of each rod 150–156 changes the characteristics of the antenna pattern 144–147 generated by that rod, a change in the dimensions of a rod 150–156 has little to no effect on the pattern characteristics of the antenna pattern 142 generated by the horn 148. Similarly, changing the dimensions of the horn 148 in order to change the pattern characteristics of the antenna pattern 142 generated by the horn 148 has little to no effect on the pattern characteristics of the antenna patterns 144–147 generated by the rods 150–154. Also, changes in the length of one rod 150 has little to no effect on the pattern characteristics of an antenna pattern 146 generated by another one of the rods 152. In this manner, the antenna 140 provides multiple antenna patterns 142–147 from a single compact configuration where the pattern characteristics of each antenna pattern 142–147 is independently controllable.

Figure 10:
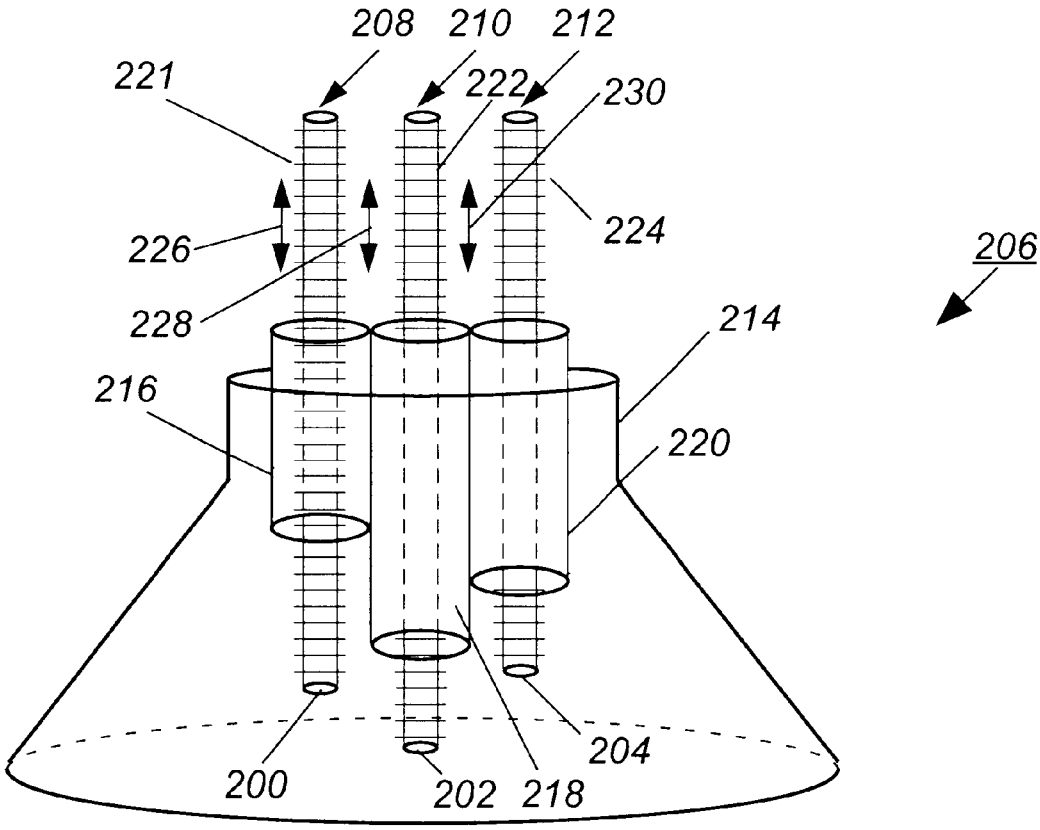

Referring to FIG. 10, for another embodiment of the invention, each rod 200–204 of the multi-pattern antenna 206 is responsive to a control signal 208–212, respectively, and is operative to dynamically adjust the portion of each rod 200–204 which extends from the conduits 216–220 into the horn 214. To do so, each rod 200–204 is initially configured with an extra amount of length 221–224 which is positioned to extend out the back of the conduits 216–220. Each rod 200–204 is attached to a mechanism (not shown) which is operative to move each rod 200–204 into and out of the horn 214 in the direction indicated by the arrows 226–230 to extend a larger or smaller portion of each rod 200–204 out of the conduits 216–220 and into the horn 214. The characteristics of each antenna pattern generated by a rod 200–204 is determined by the length of the portion of the rod 200–204 which extends from the conduits 216–220 into the horn 214. Changing the length of the portion of a rod 200–204 which extends from a conduit 216–220, respectively, into the horn 214 changes the characteristics of the antenna pattern generated by that rod 200–204. Making the rods 200–204 responsive to a control signal 208–212 provides an antenna 206 having dynamically controllable antenna pattern characteristics.

The control signals 208–212 would preferably originate on the earth but could also be generated by the electronics (not shown) on the spacecraft upon which the multi-pattern antenna 206 could be mounted. The dynamically adjustable multi-pattern antenna 206 can be used alone or coupled with a reflector (not shown) as previously described.

The dynamically adjustable multi-pattern antenna 206 is particularly useful in spacecraft applications where a broad beamwidth antenna pattern is required at a preselected time, and, a narrow beamwidth, higher gain antenna pattern at the same frequency is required at another time. For example, at a first predetermined time, the first rod 200 could be configured to generate an antenna pattern having a broad beamwidth, such as an 8.7 degree beamwidth, which would cover the entire earth from a spacecraft in a geosynchronous orbit. At a second time, a control signal 208 would be received by the first rod 200 and the portion of the rod 200 which extends into the horn 214 would be extended in length in response to the control signal 208. This changing of the length of the amount of the first rod 200, extending from the conduit 216 and into the horn 214, would alter the pattern characteristics of the antenna pattern generated by the first rod 200 by narrowing the beamwidth. In this manner, antenna patterns having dynamically controllable pattern characteristics can be generated from a single structure.

It will be appreciated by one skilled in the art that the present invention is not limited to what has been shown and described hereinabove. The scope of the invention is limited solely by the claims which follow.

What is claimed is:

1. A multi-pattern antenna for providing a first antenna pattern at a first frequency of operation and a second antenna pattern at a second frequency of operation from a single apparatus, the antenna adapted to receive a first RF signal at the first frequency and a second RF signal at the second frequency, the antenna composing:

a horn having preselected dimensions configured to generate a first antenna pattern having first antenna pattern characteristics from the first RF signal;

a conduit located within the horn and configured to propagate the second RF signal in a waveguide mode; and, a conductive corrugated rod having a first and a second portion, the first portion located inside the conduit, the second portion protruding from the conduit into the horn, the rod configured to be responsive to the second RF signal propagating in said waveguide mode and operative to transition the second RF signal from the waveguide mode to a surface wave mode and propagate the second RF signal in the surface wave mode along the rod, the rod configured to generate a second antenna pattern having second antenna pattern characteristics from the second RF signal propagating in the surface wave mode.

2. An antenna as in claim 1, wherein the second pattern characteristics are adjustable by changing the length of the second portion of the rod.

3. An antenna as in claim 2, wherein the first pattern characteristics are substantially independent of the changes in the length of the second portion of the rod.

4. An antenna as in claim 3, wherein the first pattern characteristics are adjustable by changing the dimensions of the horn, the second pattern characteristics are substantially independent of the changes in the dimensions of the horn.

5. An antenna as in claim 4, further comprising a plurality of first openings in the horn and a plurality of second openings in the conduit, the first openings configured to receive the first RF signal and the second openings configured to receive the second RF signal.

6. An antenna as in claim 5, wherein the plurality of first openings are four slots positioned about the horn approximately 90 degrees apart, the first antenna pattern being generated with circular polarization characteristics.

7. An antenna as in claim 6, wherein the plurality of second openings are two slots positioned approximately 90 degrees apart on the conduit, the second antenna pattern being generated with circular polarization characteristics.

8. An antenna as in claim 4, wherein the rod is responsive to a control signal, the length of the second portion of the rod being dynamically changeable in response to the control signal.

9. An antenna as in claim 4, wherein the first RF signal is at a frequency of approximately 20 GHz and the second RF signal is at a frequency of approximately 30 GHz.

10. An antenna as in claim 4, further comprising a reflector positioned so that the first and second antenna patterns are incident on the reflector, the reflector operative to generate first and second reflector patterns from the first and second antenna patterns, respectively.

11. An antenna as in claim 10, wherein the horn dimensions, the rod length and the reflector are configured to provide first and second reflector patterns having approximately equivalent beamwidth characteristics.

12. An antenna for providing a plurality of antenna patterns at a plurality of frequencies from a single compact structure, the antenna adapted to receive a first RF signal at a first frequency of operation and a plurality of second RF signals, each at a different frequency of operation, the antenna comprising:

a horn having preselected dimensions which are configured to generate a first antenna pattern having first antenna pattern characteristics from the first RF signal; and a plurality of conduits and rods positioned within the horn, each rod having a first portion encompassed by one of the conduits and a second portion protruding from said conduit and into the horn, each of the conduits configured to propagate one of the second RF signals in a waveguide mode;

each rod configured to be responsive to the second RF signal propagating within the conduit which encompasses the rod, each rod being operative to transition one second RF signal from the waveguide mode to a surface wave mode and propagate the one second RF signal in the surface wave mode along the second portion of the rod, each of the rods configured to radiate one second RF signal and generate therefrom a second antenna pattern.

13. An antenna as in claim 12, wherein the second pattern characteristics of each second antenna pattern is adjustable by changing the length of the second portion of the one rod which generated that respective second antenna pattern.

14. An antenna as in claim 13, further comprising a cylinder located within the horn and positioned to surround the plurality of conduits.

15. An antenna as in claim 14, wherein the first pattern characteristics are substantially independent of changes in the length of the second portion of one of the rods.

16. An antenna as in claim 15, wherein each of the second pattern characteristics is substantially independent of changes in the dimensions of the horn.

17. An antenna as in claim 16, wherein the second pattern characteristics of a second antenna pattern generated by one rod is substantially independent of changes in the length of the second portion of another rod.

18. An antenna as in claim 17, wherein each rod is responsive to a control signal, the length of the second portion of each rod being dynamically changeable in response to one of the control signals.

19. An antenna as in claim 17, further comprising a reflector positioned so that each of the first and second antenna patterns are incident on the reflector, the reflector operative to generate a first reflector pattern from the first antenna pattern and a second reflector pattern from each second antenna pattern.

* * * * *